US011464390B2

(12) United States Patent
Haegermarck et al.

(10) Patent No.: US 11,464,390 B2
(45) Date of Patent: Oct. 11, 2022

(54) FAN-SHAPED SPRAY DETERGENT NOZZLE

(71) Applicant: ELECTROLUX APPLIANCES AKTIEBOLAG, Stockholm (SE)

(72) Inventors: Anders Haegermarck, Trångsund (SE); Marie Hakkarainen, Stockholm (SE); Antonios Monokrousos, Stockholm (SE)

(73) Assignee: Electrolux Appliances Aktiebolag

( * ) Notice: Subject to any disclaimer, the term of this patent is extended or adjusted under 35 U.S.C. 154(b) by 11 days.

(21) Appl. No.: 16/755,237

(22) PCT Filed: Oct. 31, 2017

(86) PCT No.: PCT/EP2017/077862
§ 371 (c)(1),
(2) Date: Apr. 10, 2020

(87) PCT Pub. No.: WO2019/086105
PCT Pub. Date: May 9, 2019

(65) Prior Publication Data

US 2020/0237179 A1 Jul. 30, 2020

(51) Int. Cl.
*A47L 15/23* (2006.01)
*A47L 15/42* (2006.01)
(Continued)

(52) U.S. Cl.
CPC ..... *A47L 15/23* (2013.01); *A47L 15/0057* (2013.01); *A47L 15/4278* (2013.01); *A47L 15/44* (2013.01);
(Continued)

(58) Field of Classification Search
CPC ..... A47L 15/0057; A47L 15/18; A47L 15/22; A47L 15/23; A47L 15/28; A47L 15/4278;
(Continued)

(56) References Cited

U.S. PATENT DOCUMENTS 1,408,077 A 2/1922 Clinton
3,292,645 A 12/1966 Braden et al.
(Continued)

FOREIGN PATENT DOCUMENTS

DE 19736919 B4 8/2007
EP 1 238 622 B1 2/2010
(Continued)

OTHER PUBLICATIONS

International Search Report and Written Opinion for Application No. PCT/EP2017/077862 dated Jan. 11, 2018, 10 pages.

*Primary Examiner* — David G Cormier
(74) *Attorney, Agent, or Firm* — RatnerPrestia

(57) ABSTRACT

Example embodiments provide a dishwasher comprising a tub; a door configured for selectively sealing a forward access opening of the tub; a detergent dispenser located at an inner surface of the door; a spray arm mounted within the tub such that the spray arm is adjustable between a first height and a second height, the spray arm comprising a spray detergent nozzle; and a circulation pump configured to supply washing liquid to the spray arm. The dishwasher is characterized in that the spray arm is configured to emit a fan-shaped jet from the spray detergent nozzle when the washing liquid is supplied to the spray arm and the spray arm is configured to emit the fan-shaped jet that is incident upon the detergent dispenser both when the spray arm is positioned at the first height and when the spray arm is positioned at the second height.

10 Claims, 14 Drawing Sheets

(51) Int. Cl.
*A47L 15/44* (2006.01)
*A47L 15/50* (2006.01)
*A47L 15/00* (2006.01)

(52) U.S. Cl.
CPC ..... *A47L 15/4409* (2013.01); *A47L 15/504* (2013.01)

(58) Field of Classification Search
CPC .... A47L 15/428; A47L 15/4282; A47L 15/44; A47L 15/4409; A47L 15/4418; A47L 15/4436; A47L 15/504
See application file for complete search history.

(56) References Cited

U.S. PATENT DOCUMENTS

| | | | |
|---|---|---|---|
| 3,771,725 | A | 11/1973 | Jenkins et al. |
| 4,210,285 | A | 7/1980 | Dicken, Jr. et al. |
| 7,988,791 | B2 | 8/2011 | Delgado |
| 8,211,243 | B2 | 7/2012 | Delgado |
| 2004/0000331 | A1* | 1/2004 | Elick ..... A47L 15/22 134/180 |
| 2005/0045672 | A1 | 3/2005 | Marone |
| 2005/0051201 | A1 | 3/2005 | Ashton et al. |
| 2005/0230502 | A1 | 10/2005 | Bragg et al. |
| 2009/0145468 | A1 | 6/2009 | Chericoni |
| 2009/0255560 | A1 | 10/2009 | Lehmann et al. |
| 2012/0279536 | A1 | 11/2012 | Adams et al. |
| 2012/0305037 | A1 | 12/2012 | Petric et al. |
| 2014/0054395 | A1 | 2/2014 | Heisele et al. |
| 2014/0345654 | A1 | 11/2014 | Cho et al. |

FOREIGN PATENT DOCUMENTS

| | | | |
|---|---|---|---|
| EP | 2 441 369 | A2 | 4/2012 |
| EP | 2 067 428 | B1 | 11/2014 |
| EP | 2 240 065 | B1 | 9/2015 |
| IT | TO 20030117 | U1 | 1/2005 |
| JP | H04-338438 | A | 11/1992 |
| JP | H07-163505 | A | 6/1995 |
| JP | H07-250799 | A | 10/1995 |
| JP | H10-127560 | A | 5/1998 |
| JP | 2861792 | B2 | 2/1999 |
| JP | 2009 082393 | A | 4/2009 |
| WO | WO 2006/069827 | A1 | 7/2006 |
| WO | WO 2009/083576 | A1 | 7/2009 |
| WO | WO 2011/147716 | A1 | 12/2011 |
| WO | WO 2014/048164 | A1 | 4/2014 |
| WO | WO 2017/108072 | A1 | 6/2017 |
| WO | WO 2018/006976 | A1 | 1/2018 |

* cited by examiner

FAN-SHAPED SPRAY DETERGENT NOZZLE

CROSS-REFERENCE TO RELATED APPLICATIONS

This application is a national stage application filed under 35 U.S.C. § 371 of International Application No. PCT/EP2017/077862 filed Oct. 31, 2017, which application is hereby incorporated by reference in its entirety.

BACKGROUND

Field of the Invention

The present invention generally relates to appliances, such as dishwashers, that have spray nozzles. In particular, the present invention relates to a fan spray nozzle disposed on a spray arm of a dishwasher.

Description of Related Art

Today's dishwashers are expected to perform high quality wash of dishware while being efficient in their use of energy and water during operation. A dishwasher usually comprises a washing chamber in which an upper rack, a middle rack, and/or a lower rack for accommodating items to be washed are arranged. In some modern dishwashers it is possible to adjust one or more of the racks in height to adapt the rack to different sizes of dishes. Further, a dishwasher usually comprises an upper wash arm, a middle wash arm, and/or a lower wash arm. The upper wash arm may be attached to an upper rack, the middle wash arm may be attached to the middle rack, and the lower wash arm may be attached to a lower rack. If a wash arm is attached to a height adjustable rack, the relationship between spray nozzles located on the spray arm and other elements within the dishwasher (e.g., the corners of the rack, the detergent dispenser, and/or the like) will change when the height of rack is changed.

Dishwashers also use detergent dispensers to release detergent into the tub for cleaning the dishware. The detergent dispenser may be cleaned with a nozzle, for example, on the middle spray arm. However, if one were to make the middle spray arm and middle rack height adjustable, the fluid sprayed out of nozzles that do not align with the current position of the middle rack would be sprayed against the wall of the washing chamber and would miss the detergent dispenser.

Accordingly, there is a need in the art for improved detergent dispenser clean out nozzles for use with height adjustable dish racks, and there is a need for reducing the number of non-cleaning nozzles in the spray assembly to effectively utilize the available water pressure.

BRIEF SUMMARY

Embodiments of the present invention address the above by providing a detergent dispenser clean out nozzle that produces a fan-shaped jet. Example embodiments of the present invention provide a dishwasher with a height adjustable middle rack having a spray arm attached thereto, wherein the spray arm comprises a detergent dispenser clean out nozzle that produces a fan-shaped jet. The shape of the fan-shaped jet may be configured to sufficiently clean out the detergent dispenser when the middle rack of the dishwasher is in a first position or second position. For example, the middle rack may be adjustable between a plurality of positions but the middle spray arm attached to the middle rack may only require a single detergent dispenser clean out nozzle. In an example embodiment, the detergent dispenser clean out nozzle may also act as a driving nozzle for the middle spray arm. In an example embodiment, a fan-shaped jet may be a jet that is generally planar or two-dimensional and expands outward from a first end where the fan-shaped jet leaves the corresponding nozzle to an end opposite the nozzle. For example, the fan-shaped jet may be shaped as a sector of a circle or an ellipse wherein the center of the circle or the ellipse is located at the nozzle and/or within the spray arm such that the nozzle defines the angle θ of the sector.

According to a first aspect of the present invention, a dishwasher is provided. In an example embodiment, the dishwasher comprises a tub; a door configured for selectively sealing a forward access opening of the tub; a detergent dispenser located at an inner surface of the door; a spray arm mounted within the tub such that the spray arm is adjustable between a first height and a second height, the spray arm comprising a spray detergent nozzle; and a circulation pump configured to supply washing liquid to the spray arm. The dishwasher is characterized in that the spray arm is configured to emit a fan-shaped jet from the spray detergent nozzle when the washing liquid is supplied to the spray arm and the spray arm is configured to emit the fan-shaped jet that is incident upon the detergent dispenser both when the spray arm is positioned at the first height and when the spray arm is positioned at the second height.

In an example embodiment, the spray detergent nozzle is a drive nozzle of the spray arm configured to cause the spray arm to rotate. In an example embodiment, the spray arm is rotatable within a plane of rotation, and spray arm is adjustable along an axis perpendicular to the plane of rotation between the first height and the second height. In an example embodiment, the spray arm further comprises a corner nozzle positioned adjacent the spray detergent nozzle. In an example embodiment, the corner nozzle and the spray detergent nozzle are separated by a nozzle differentiation wall. In an example embodiment, the corner nozzle and the spray detergent nozzle share a fluid supply channel. In an example embodiment, the spray arm comprises a satellite arm. In an example embodiment, the spray arm comprises a satellite side fluid supply channel for providing washing liquid to the satellite arm and a driving side fluid supply channel for providing water to the spray detergent nozzle. In an example embodiment, the driving side fluid supply channel is narrower than the satellite side fluid supply channel. In an example embodiment, the spray arm is rotatably attached to a fluid supply conduit, and the fluid supply conduit is attached to a height-adjustable dish rack, such that the dish rack is configured to move the spray arm between the first height and the second height. In an example embodiment, the spray detergent nozzle and the fan-shaped jet define a fan spread plane in which the fan-shaped jet is disposed, the fan spread plane being generally vertical. In an example embodiment, the spray detergent nozzle and the fan-shaped jet define a resulting force direction, the resulting force direction being generally tangent and opposite to the direction of rotation of the spray arm. In an example embodiment, the angular extent of the fan-shaped jet is configured such that the width of the fan-shaped jet, when the fan-shaped jet is incident on the door, is at least the difference between the first height and the second height.

BRIEF DESCRIPTION OF THE SEVERAL VIEWS OF THE DRAWING(S)

Having thus described embodiments of invention in general terms, reference will now be made to the accompanying drawings, which are not necessarily drawn to scale, and wherein:

Figure 11:
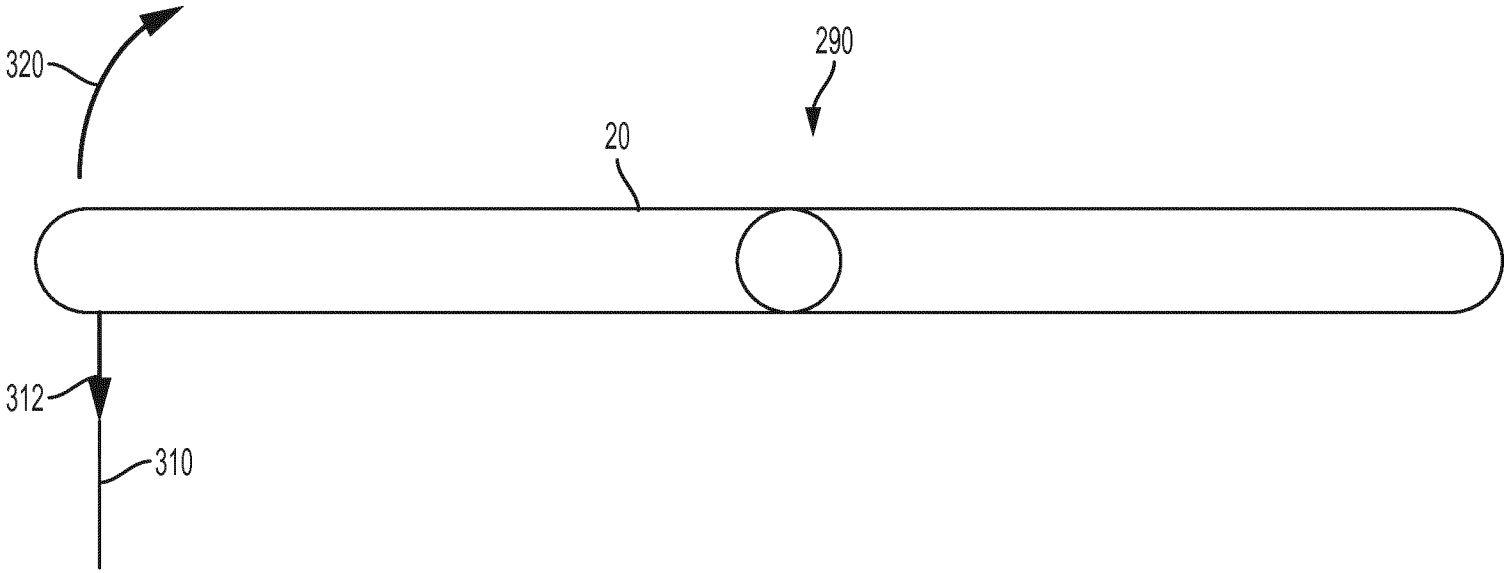
Figure 12:
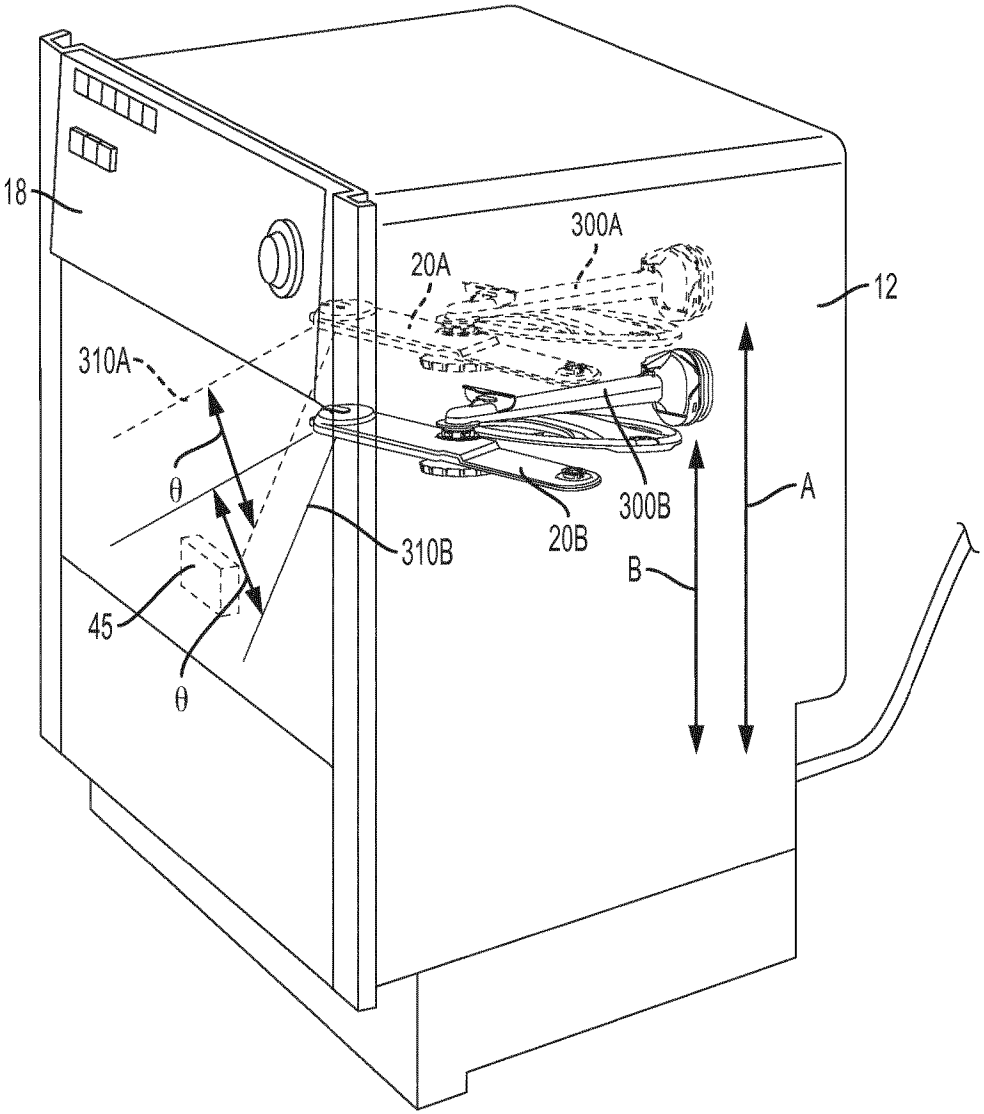

FIG. 11 is a schematic diagram providing an overhead view of a spray arm having a spray detergent nozzle, in accordance with an example embodiment; and FIG. 12 is a schematic diagram illustrating the fan-shaped spray of the spray detergent nozzle, in accordance with an example embodiment, cleaning out a detergent dispenser at a first position of the middle rack and a second position of the middle rack.

DETAILED DESCRIPTION OF SOME EXAMPLE EMBODIMENTS

The present invention now will be described more fully hereinafter with reference to the accompanying drawings, in which some, but not all embodiments of the invention or inventions are shown. Indeed, these inventions may be embodied in many different forms and should not be construed as limited to the embodiments set forth herein; rather, these embodiments are provided so that this disclosure will satisfy applicable legal requirements. The term "or" (also designated as"/") is used herein in both the alternative and conjunctive sense, unless otherwise indicated. The terms "illustrative" and "exemplary" are used to be examples with no indication of quality level. As used herein, the terms "approximately" and "generally" refer to within manufacturing and/or engineering tolerances for the corresponding materials and/or elements, unless otherwise indicated. Like numbers refer to like elements throughout.

Overview of an Example Dishwasher

Figure 1:
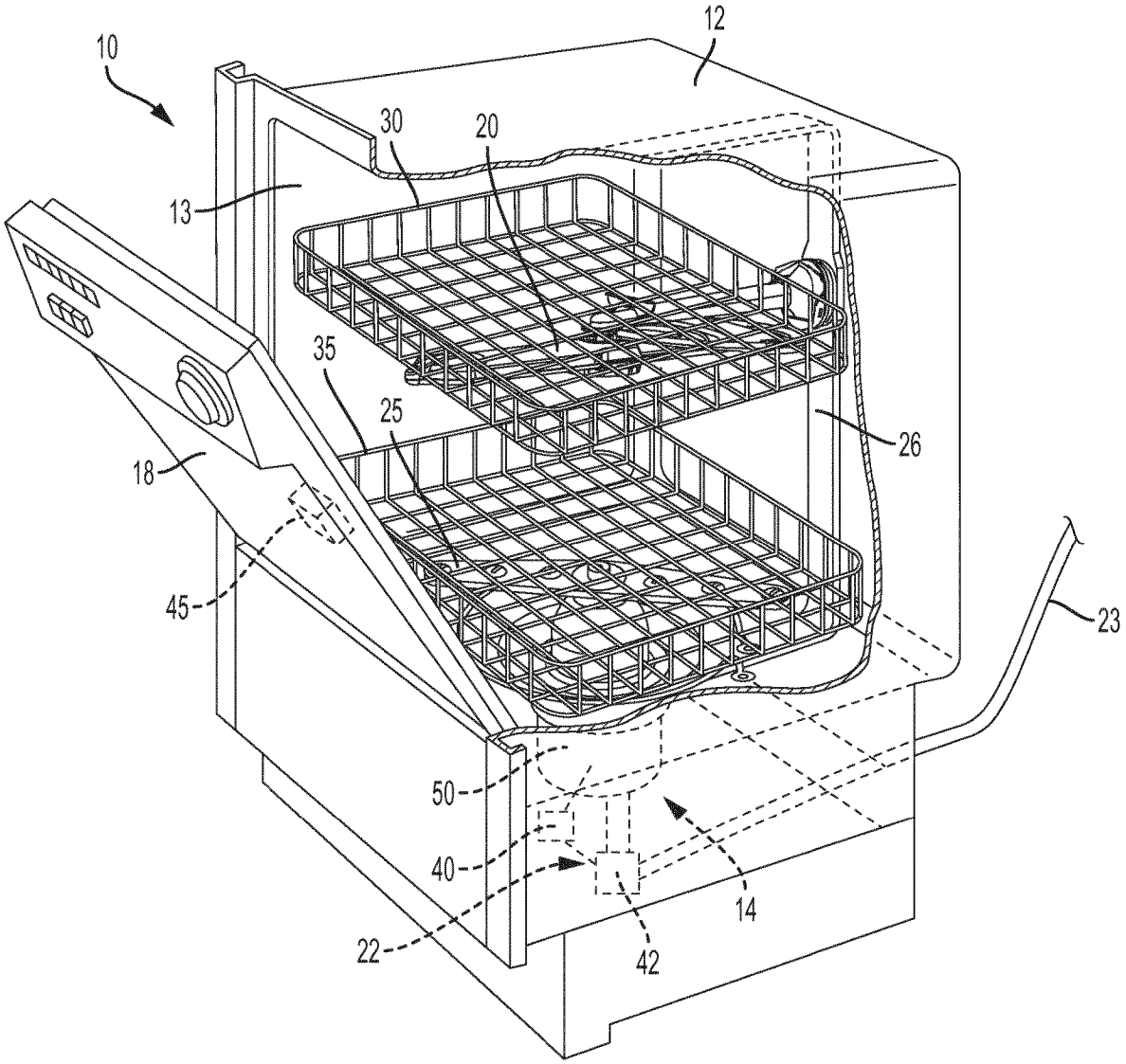
FIG. 1 is a perspective view of a dishwasher of a type suitable for use with various embodiments of the present invention.

FIG. 1 illustrates one example of a dishwasher 10 capable of implementing various embodiments of the present invention. Such a dishwasher 10 typically includes a tub 12 (partly broken away in FIG. 1 to show internal details), having a plurality of walls (e.g., side wall 13) for forming an enclosure or washing chamber in which dishes, utensils, and other dishware may be placed for washing. A door 18 may be pivotably engaged (e.g., about a hinge) with the tub 12 to selectively permit access to the interior of the tub 12. For example, the door 18 may comprise an open configuration and a closed configuration, such that the door 18 may at least substantially seal the forward access opening of the tub 12 in the closed configuration.

The door 18 may comprise an inner surface that acts as a wall of the tub 12 when the door 18 is in the closed position. A detergent dispenser 45 may be disposed on and/or embedded in the inner surface of the door 18. A user of the dishwasher 10 may provide detergent into the detergent dispenser 45 before starting a dishwashing program such that the detergent may be provided to the wash water within tub during a pre-wash and/or wash cycle of the dishwashing program. In an example embodiment, the detergent dispenser 45 comprises a hinged door that the user closes before starting the dishwashing program and that is electromechanically opened during a wash cycle of the dishwashing program by a controller 40, and/or the like.

The tub 12 may include a sump 14 in which wash water or rinse water is collected, typically under the influence of gravity. The wash/rinse water may be pumped by a circulation pump 50 to one or more spray arms (e.g., lower spray arm 25, middle spray arm 20) mounted in the interior of the tub 12 (e.g., mounted to a lower or middle rack which is not shown or mounted to a wall 13 of the tub 12) for spraying the wash/rinse water, under pressure, onto the dishes, utensils, and other dishware contained therein. For example, the circulation pump 50 may be configured to pump wash water through a circulation hose 26 to the middle spray arm 20 for spraying into the tub 12, such as through one or more spray nozzles located on the middle spray arm 20. The dishwasher may also include an upper spray arm (not shown) disposed proximate the top of the tub 12 and configured to spray downwardly towards an upper rack and/or the middle rack.

The dishwasher 10 may also comprise a controller 40 that may be in communication with one or more of the operational components of the dishwasher 10. For example, the controller 40 may be in communication with the circulation pump 50 and may be configured to selectively operate the circulation pump 50 to pump wash water to at least one spray arm and/or spray nozzle. In some embodiments, the controller 40 may be in communication with the detergent dispenser to release the detergent at a predetermined time during a dishwasher program cycle. In another example, the controller 40 may be in communication with the water inflow system (not shown) configured to provide water to the dishwasher 10. In various embodiments, the controller 40 may be in communication with a drain pump 42 configured to pump wash fluid out of the dishwasher 10 via drain pipe 23. In some embodiments, the controller 40 may comprise a processor and/or other computing means such that operations can be performed in the dishwasher. Additionally or alternatively, the controller 40 may comprise a memory (e.g., volatile memory and/or nonvolatile memory) for storage of data and/or executable instructions such as routines for operation of the dishwasher. In some embodiments, the controller 40 may further comprise a communications interface for communicating with various elements of the dishwasher 10 (e.g., circulation pump 50, a door sensor, user interface sensor, and/or the like) or for communicating with one or more computing devices via a wired or wireless network (e.g., the Internet, a local Wi-Fi network, and/or the like). In some embodiments, the controller 40 may comprise a mechanical timer in addition to or in place of a processor. In some embodiments, the controller 40 may be housed in the lower end 22 of the dishwasher 10 beneath the tub 12.

The dishwasher 10 may also include at least one dish rack 30, 35 for holding the dishes, utensils, and dishware. The dish rack 30, 35 can be positioned within the tub 12 to hold dishware for cleaning, such as through wash water that is sprayed onto the dishware from the spray arms and/or spray nozzles. For example, in one example embodiment, middle spray arm 20 may be secured to the underside of an upper or middle rack 30 configured for holding dishes, utensils, and/or dishware. In various embodiments, one or more of the dish racks 30, 35 may be height adjustable. For example, the middle rack 30 may be adjustable between a first position and a second position, such that when the middle rack 30 is in the first position, the distance between the middle rack 30 and the lower rack 35 is a greater distance than when the middle rack 30 is in the second position.

Figure 2:
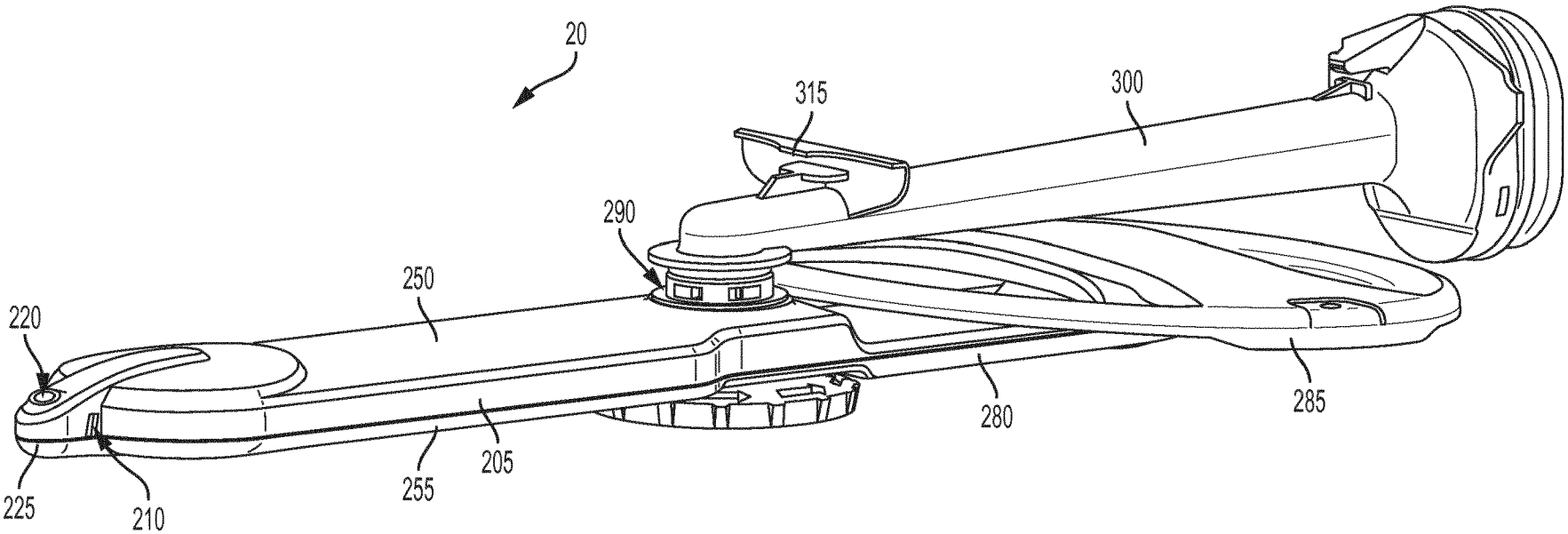
FIG. 2 is a perspective view of a spray arm comprising a spray detergent nozzle in accordance with an example embodiment of the present invention.

In an example embodiment, the middle spray arm 20 may be coupled to a fluid conduit 300 (see FIG. 2). For example, the middle spray arm 20 is rotatably coupled and/or attached to the fluid conduit 300. In some embodiments, the fluid conduit 300 is coupled and/or attached to a corresponding dish rack 30. For example, in an example embodiment, the fluid conduit 300 may be coupled to a height adjustable dish rack 30 and may move when the dish rack 30 is adjusted between a first position and/or height and a second position and/or height. In an example embodiment, the fluid conduit comprises a flexible coupling on an end of the fluid conduit that is opposite the spray arm 20 that is configured to engage the water circulation hose 26 at various heights and/or positions. For example, the fluid conduit 300 comprises a flexible coupling configured to engage the water circulation hose 26 when the height adjustable dish rack 30 is in the first position and/or height and when the height adjustable dish rack 30 is in the second position and/or height.

Embodiments of the present invention generally relate to a spray detergent nozzle 210 (see FIG. 2) configured to clean out washing liquid a detergent dispenser 45 with washing liquid (e.g., spray washing liquid into the detergent dispenser). In an example embodiment, the spray detergent nozzle is disposed on a middle spray arm 20. The middle spray arm 20 may be mounted to a height adjustable middle rack or may be mounted to a wall 13 of the tub in a height adjustable manner. In an example embodiment, the jet provided by the spray detergent nozzle is configured to clean out, spray, and/or the like the detergent dispenser 45 regardless of the height position of the middle rack or middle spray arm. In an example embodiment, the spray detergent nozzle may be a driver nozzle of the middle spray arm 20. In an example embodiment the spray detergent nozzle may be disposed on the middle spray arm 20 in close proximity to a corner nozzle 220 (see FIG. 2) to clean the corners of the dish rack. Example embodiments of the present invention therefore provide multiple advantages. In particular, the spray detergent nozzle 210 may create a fan-shaped jet of washing liquid that covers a wide vertical area, such that only one spray detergent clean out nozzle is required to be present in the dishwasher 10 even if the middle spray arm is mounted within the tub 12 in a height adjustable manner Additionally, in example embodiments in which the spray detergent nozzle 210 acts as the driving nozzle for the spray arm 20, the jet provided by the fan-shaped detergent nozzle is utilized to affect the performance of the dishwasher even when the detergent dispenser 45 does not need to be cleaned out (e.g., during the rinse cycle, after the detergent dispenser 45 has been thoroughly cleaned out, and/or the like). Therefore, example embodiments of the dishwasher 10, upper spray 25, and/or spray detergent nozzle 210 (e.g., see FIG. 2) provide the advantage of energy and water efficient use of the jet provided by the spray detergent nozzle 210.

Exemplary Spray Arm

Example embodiments provide a spray arm, for example a middle spray arm 20, having a spray detergent nozzle 210. In an example embodiment, the spray arm 20 may be an upper spray arm (e.g., coupled to an upper dish rack or the top of the tub), middle spray arm (e.g., coupled to a middle dish rack), a spray arm located above the lower rack (e.g., coupled to an upper or middle dish rack), the spray arm located at a height that is closest to the height of the detergent dispenser 45, and/or the like. FIG. 2 provides a perspective view of an example spray arm 20 having a spray detergent nozzle 210. Fluid is supplied to the spray arm 20 via water conduit 300. The water conduit 300 is configured to receive washing liquid (e.g., wash and/or rinse water) from the water circulation hose 26 and provide the washing liquid to the spray arm 20. For example, when the circulation pump 50 is operated, the circulation pump 50 may pump the washing liquid through the water circulation hose 26 to the water conduit 300. In the depicted embodiment, the spray arm 20 is rotatably mounted on, coupled to, attached to, and/or the like the water conduit 300 and the water conduit is mounted to a height adjustable dish rack 30 via a mounting element 315. In an example embodiment, the spray arm 20 is mounted to a wall 13 of the tub 12 in a height adjustable manner (e.g., via the water conduit 300). For example, as shown in FIG. 12, the spray arm 20 may be moved between a first position at a first height A and a second position at a second height B. First height A is different than and greater than second height B relative to the sump of the dishwasher. Said differently, the spray arm 20 may be movable vertically relative to the in-use orientation of the dishwasher.

In the embodiment shown in FIG. 2, the spray arm 20 is mounted to the water conduit 300 at mounting point 290. Generally, mounting point 290 is configured to provide water from the water conduit to one or more water channels within the spray arm 20. Generally, the spray arm 20 is configured to rotate about the mounting point 290. In an example embodiment, the spray arm 20 comprises a driving side 205 and a satellite arm 285 mounted to a satellite side 280. In an example embodiment, the satellite arm 285 may comprise a plurality of nozzles configures to spray jets of washing liquid onto dishes, utensils, and/or dishware within the dishwasher. For example, the satellite arm 285 may be similar to the second wash arm described in Intl. Appl. No. PCT/EP2016/066289, filed Jul. 8, 2016, the contents of which are hereby incorporated by reference. The driving side 205 and satellite side 280 may share a common axis along the length of spray arm 20. However, the driving side 205 and the satellite side 280 extend in generally opposite directions from the mounting point 290. As should be understood, in another example embodiment, the spray arm 20 does not comprise a satellite arm 285.

In an example embodiment, a spray detergent nozzle 210 may be disposed on the driving side 205. For example, a spray detergent nozzle 210 may be disposed at an end of the driving side 205 that is generally opposite of where the driving side 205 meets the mounting point 290. The spray detergent nozzle 210 may be configured to spray a fan-shaped jet of washing liquid (e.g., wash and/or rinse water)

that impinges on the detergent dispenser 45 and thereby cleans out the detergent dispenser 45 at each height position of the spray arm 20.

The spray detergent nozzle 210 may further be configured to act as the drive nozzle for the spray arm 20. For example, the spray detergent nozzle 210 may be configured such that when washing liquid (e.g., wash and/or rinse water) washing liquid is provided to the spray arm 20 (e.g., by the circulation pump 50 via the water conduit 300 and the water circulation hose 26) the spray detergent nozzle 210 produces a fan-shaped jet of water that imparts a torque to the spray arm 20 relative to the mounting point 290. The torque imparted to the spray arm 20 by the fan-shaped jet of water produced by the spray detergent nozzle 210 causes the spray arm 20 to rotate about the mounting point 290. The rotation of the spray arm 20 may be within/on a plane that is substantially horizontal (e.g., perpendicular to the vertical, height changing positions).

In an example embodiment, the driving side 205 may further comprise a corner nozzle 220 configured to spray a jet of washing liquid onto any dishes, utensils, and/or dishware positioned within the corners of the racks and/or along the edges of the tub 12. In an example embodiment, the corner nozzle 220 may be adjacent the spray detergent nozzle 210 at or proximate the distal end of the driving side 205. For example, the driving side 205 may comprise a protrusion 225, in an example embodiment. The corner nozzle 220 and the spray detergent nozzle 210 may be disposed on the protrusion 225.

Figure 3A:
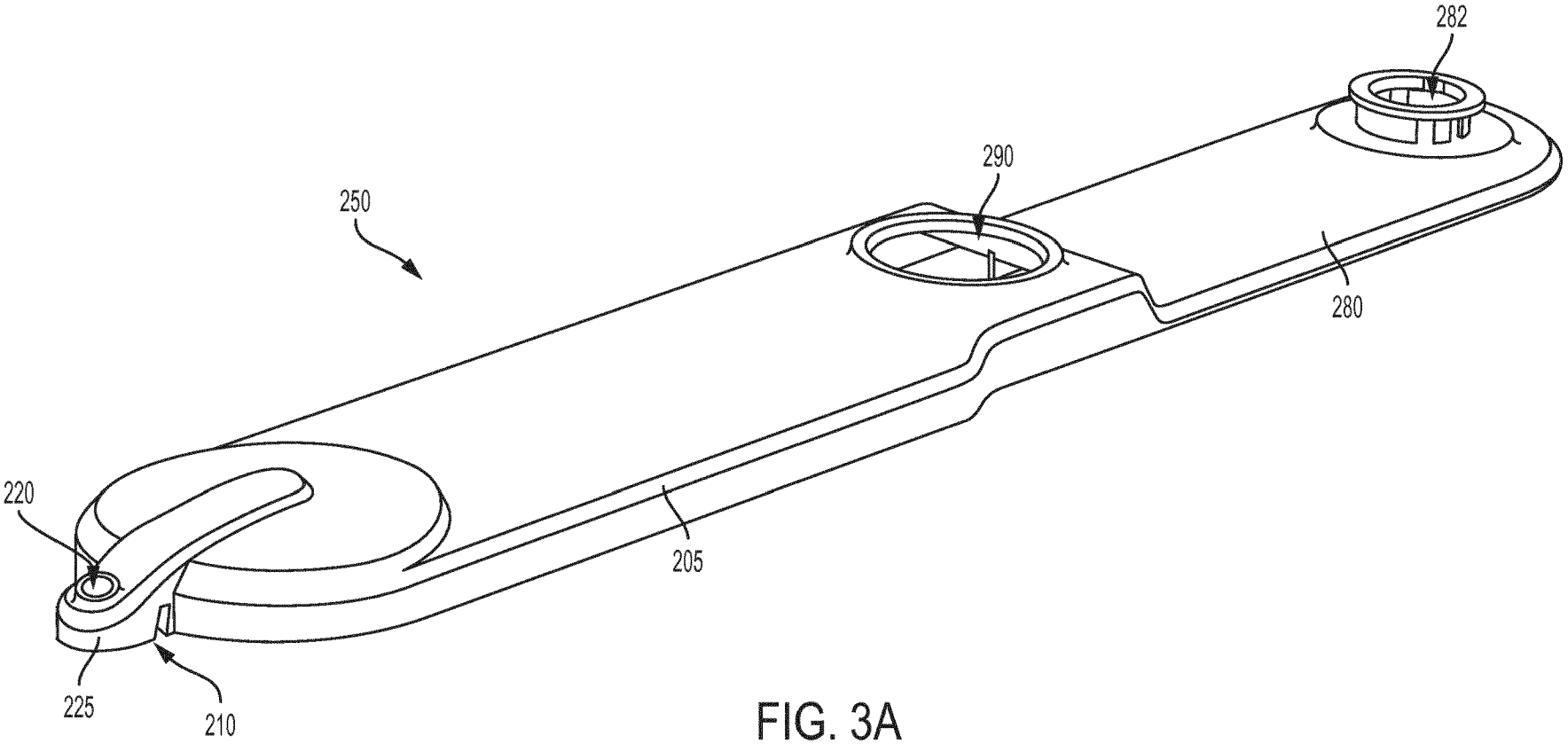
FIG. 3A is a top perspective view of a top part of a spray arm having a spray detergent nozzle, in accordance with an example embodiment.
Figure 3B:
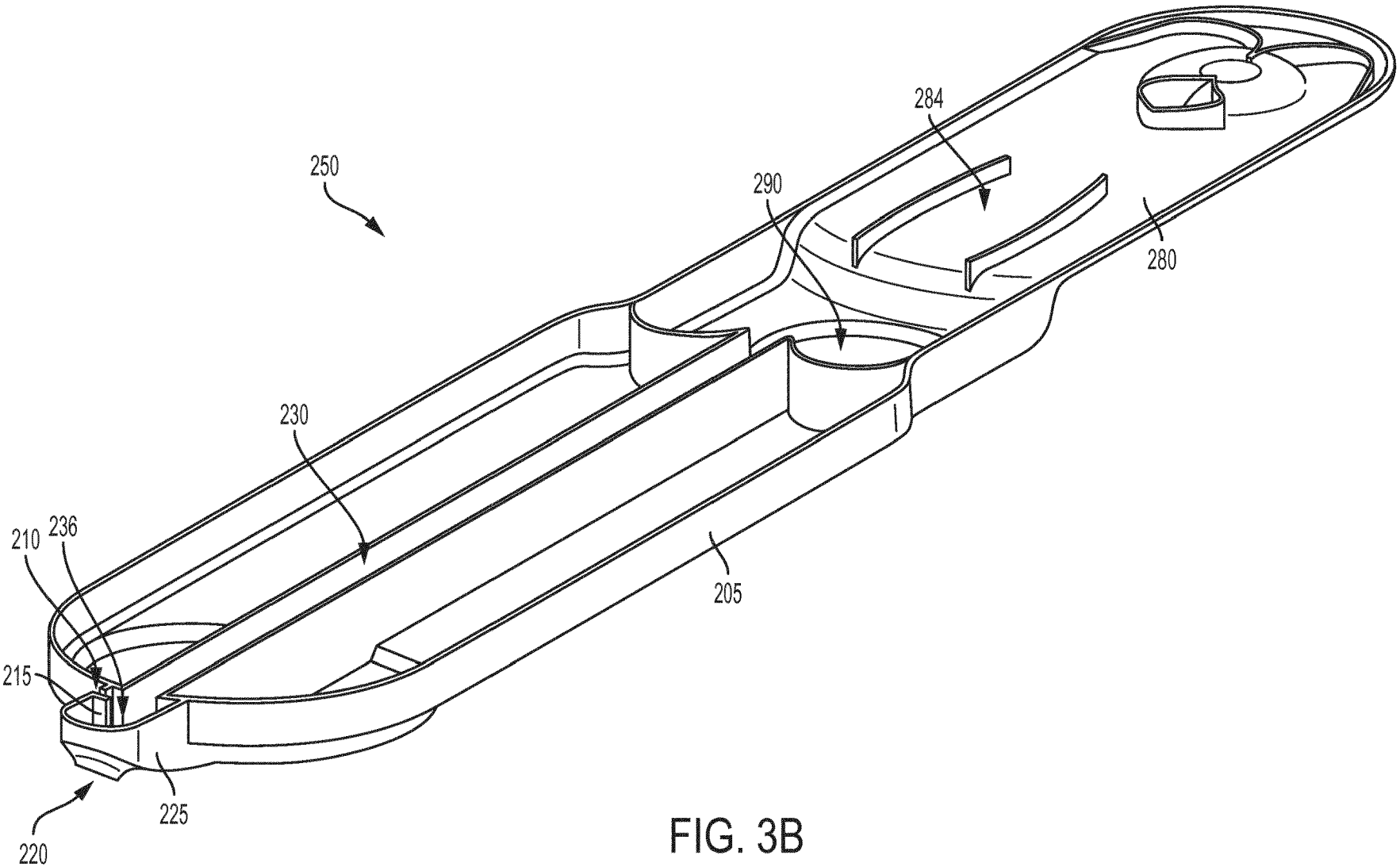
FIG. 3B is a bottom perspective view of a top part of a spray arm having a spray detergent nozzle, in accordance with an example embodiment.

In an example embodiment, the spray arm 20 may comprise a top portion 250 and a bottom portion 255. In an example embodiment, the top portion 250 and the bottom portion 255 may be molded and/or otherwise manufactured separately and then joined together to form the main arm portion of the spray arm 20. However, in one example embodiment, the spray arm 20 may be manufactured as one piece that may be similar in structure to the structure of the top portion 250 and bottom portion 255 once they are joined together. FIGS. 3A and 3B provide top and bottom perspective views, respectively, of an example top portion 250 and FIGS. 4A and 4B provide bottom and top perspective views, respectively, of an example bottom portion 255.

As shown in FIG. 3A, and noted above, the satellite side 280 extends away from the pivot point 290 along a satellite side axis extending radially, longitudinally along the length of the arm. In an example embodiment, a satellite arm mounting element 282 is disposed at an end of the satellite side 280 that is opposite the pivot point 290. As shown in FIGS. 3B and 4A, the satellite side 280 further comprises a satellite side fluid supply channel 284. The satellite side fluid supply channel 284 is configured to receive washing liquid from the water conduit 300 and supply and/or provide the washing liquid to the satellite arm 285. In an example embodiment that does not have a satellite arm 285, the satellite side fluid supply channel 284 may be configured to supply and/or provide the washing liquid to a plurality of nozzles disposed on the satellite side 280. In the example embodiment that does not have a satellite arm, the spray arm 20 may include one or more spray nozzles along both the driving side and satellite side.

In an example embodiment, the driving side 205 extends away from the pivot point 290 along a driving side axis. In an example embodiment, the driving side axis is parallel to the satellite side axis and may be coaxial with the satellite side axis. In an example embodiment, a spray detergent nozzle 210 is disposed near an end of the driving side 205 that is opposite the pivot point 290. For example, a protrusion 225 may be disposed at an end of the driving side 205 that is opposite the pivot point 290. A spray detergent nozzle 210 may be disposed on a side of the protrusion 225. For example, the fan-shaped detergent nozzle 210 may be disposed on a side of the protrusion 225 that is generally parallel to the driving side axis.

Figure 4A:
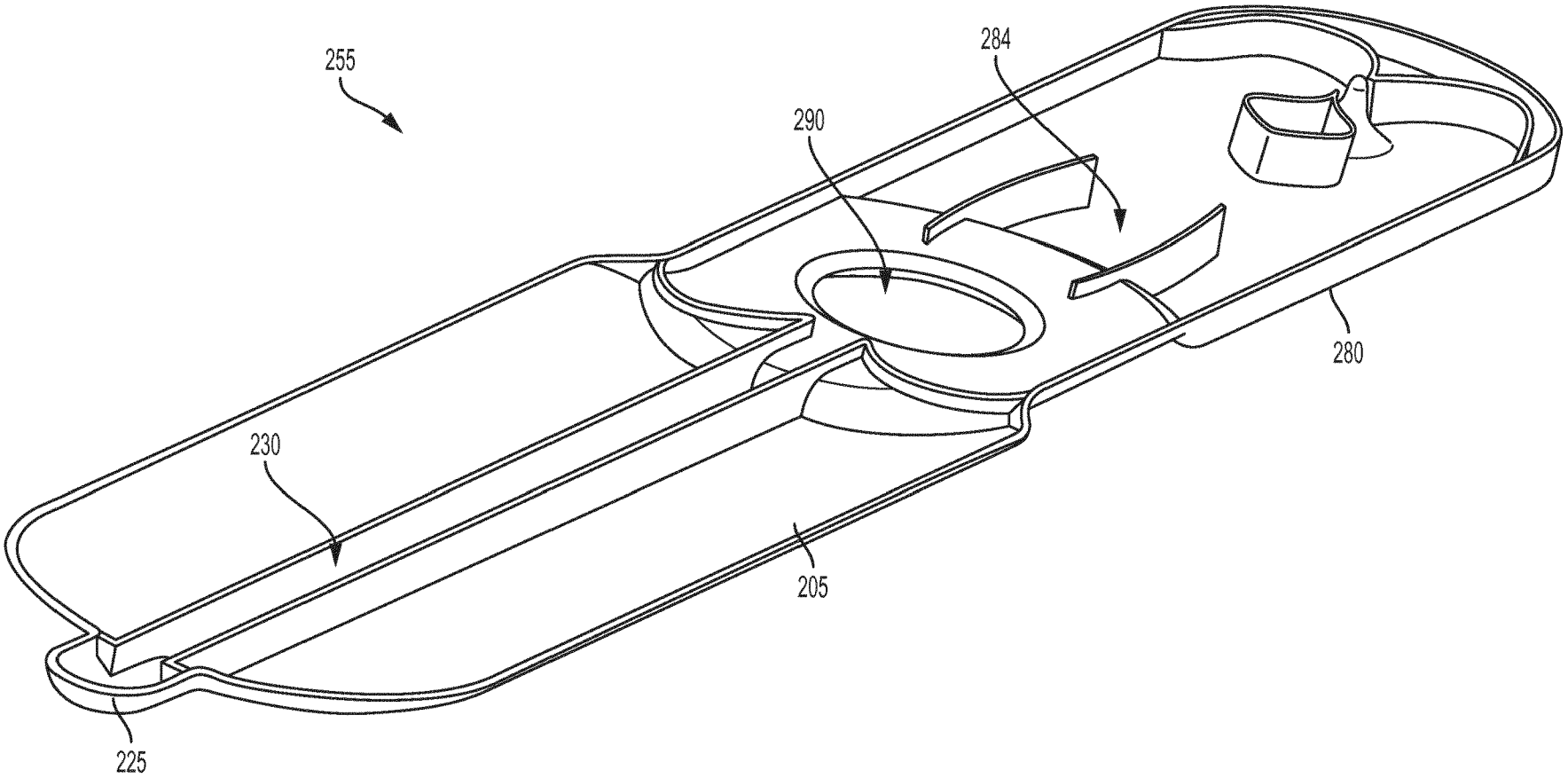
FIG. 4A is a top perspective view of a bottom part of a spray arm having a spray detergent nozzle, in accordance with an example embodiment.
Figure 4B:
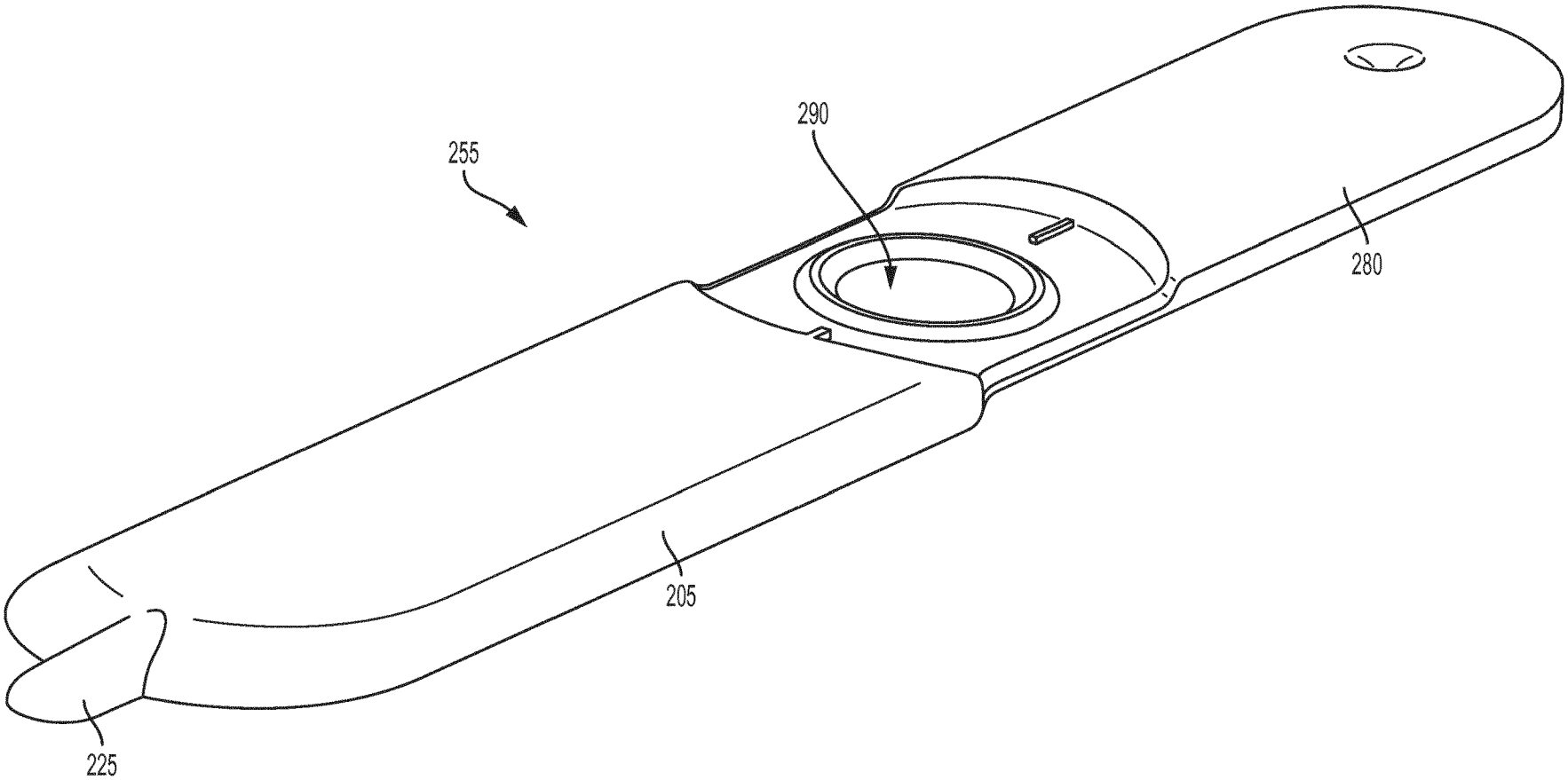
FIG. 4B is a bottom perspective view of a bottom part of a spray arm having a spray detergent nozzle, in accordance with an example embodiment.
Figure 5:
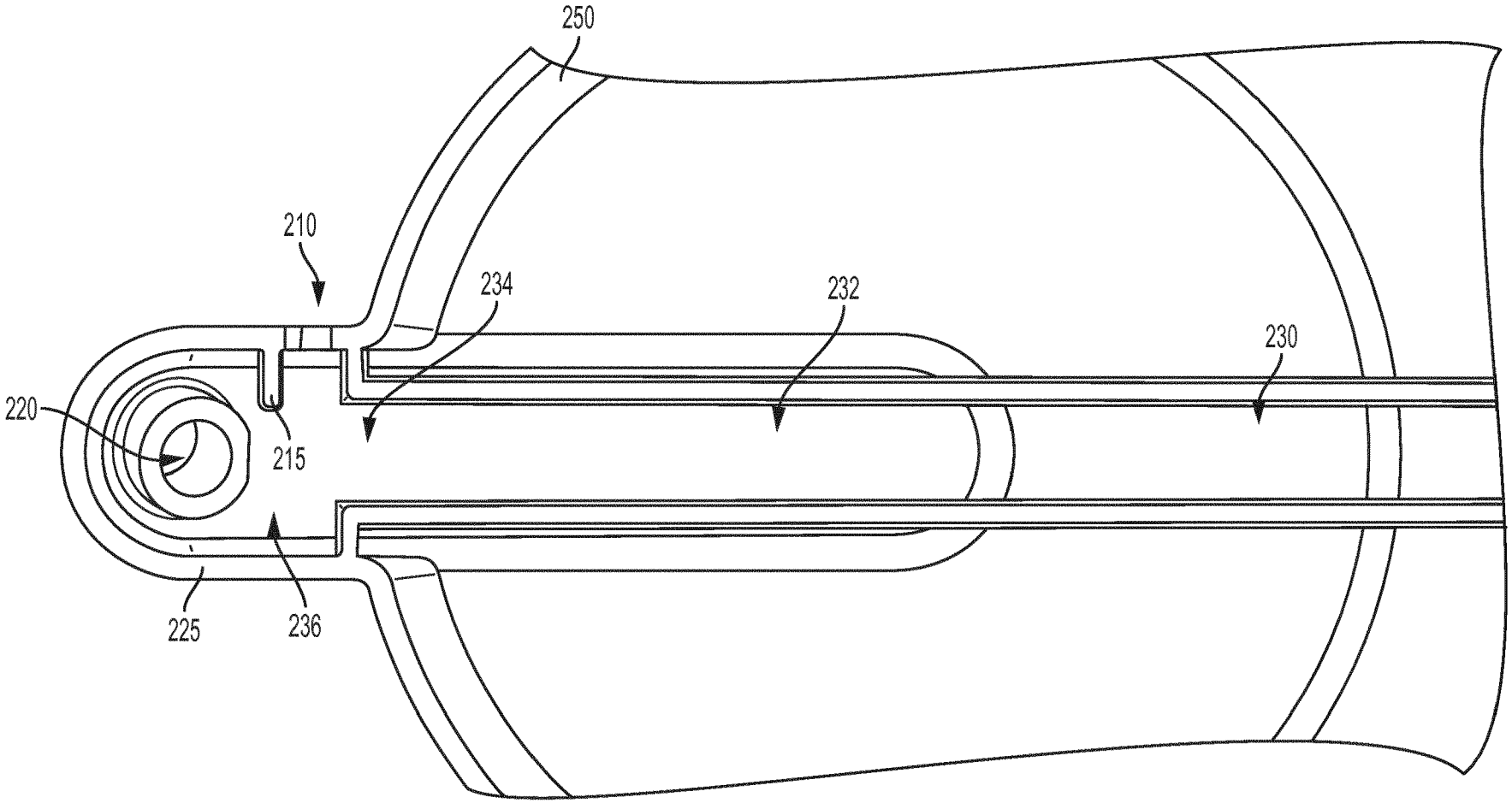
FIG. 5 is a bottom view of a portion of a top part of a spray arm having a spray detergent nozzle, in accordance with an example embodiment.
Figure 6:
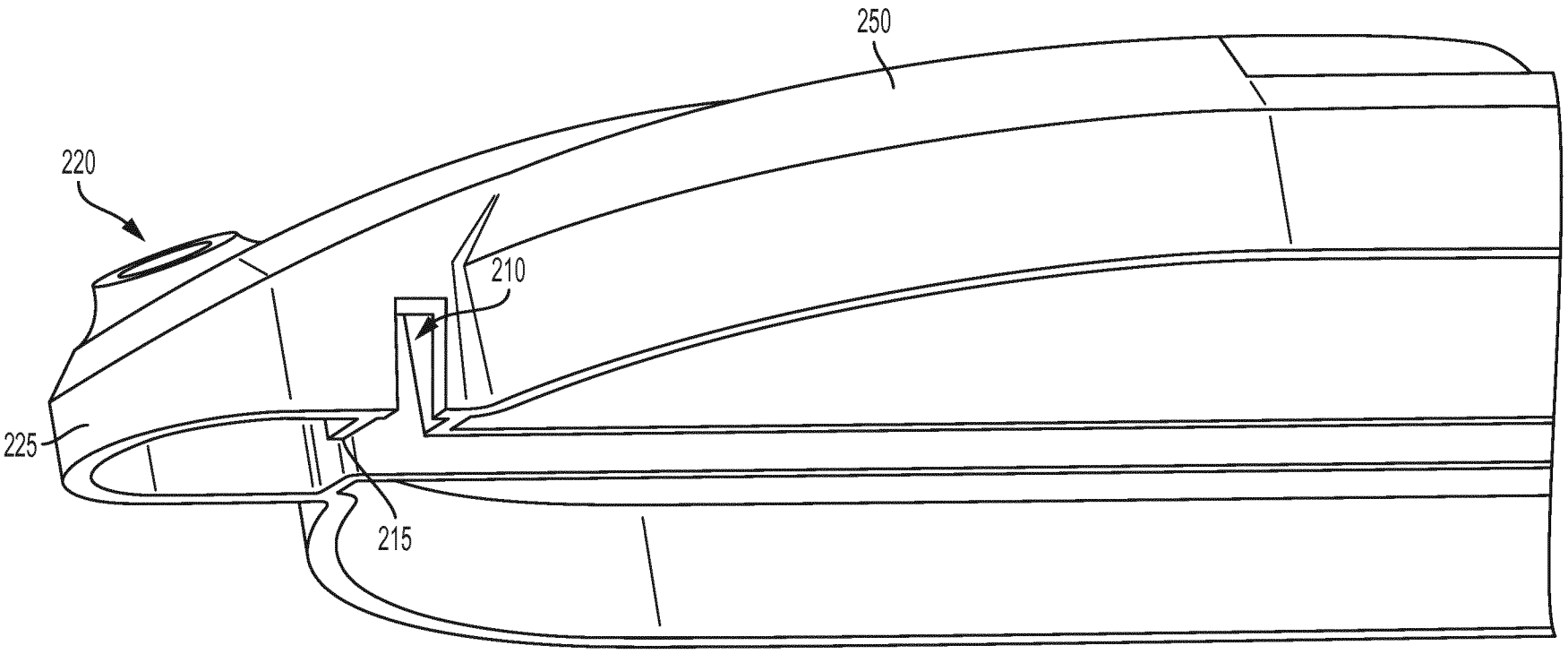
FIG. 6 is a side perspective view of a portion of a top part of a spray arm having a spray detergent nozzle, in accordance with an example embodiment.
Figure 7:
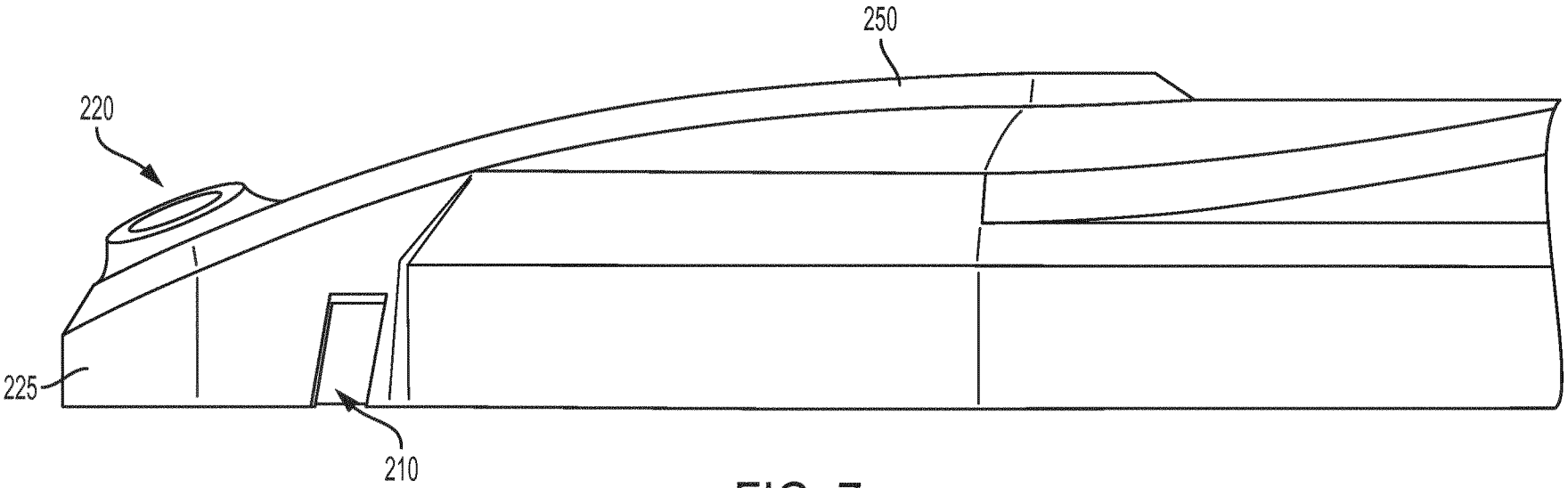
FIG. 7 is a side view of a portion of a top part of a spray arm having a spray detergent nozzle, in accordance with an example embodiment.
Figure 8:
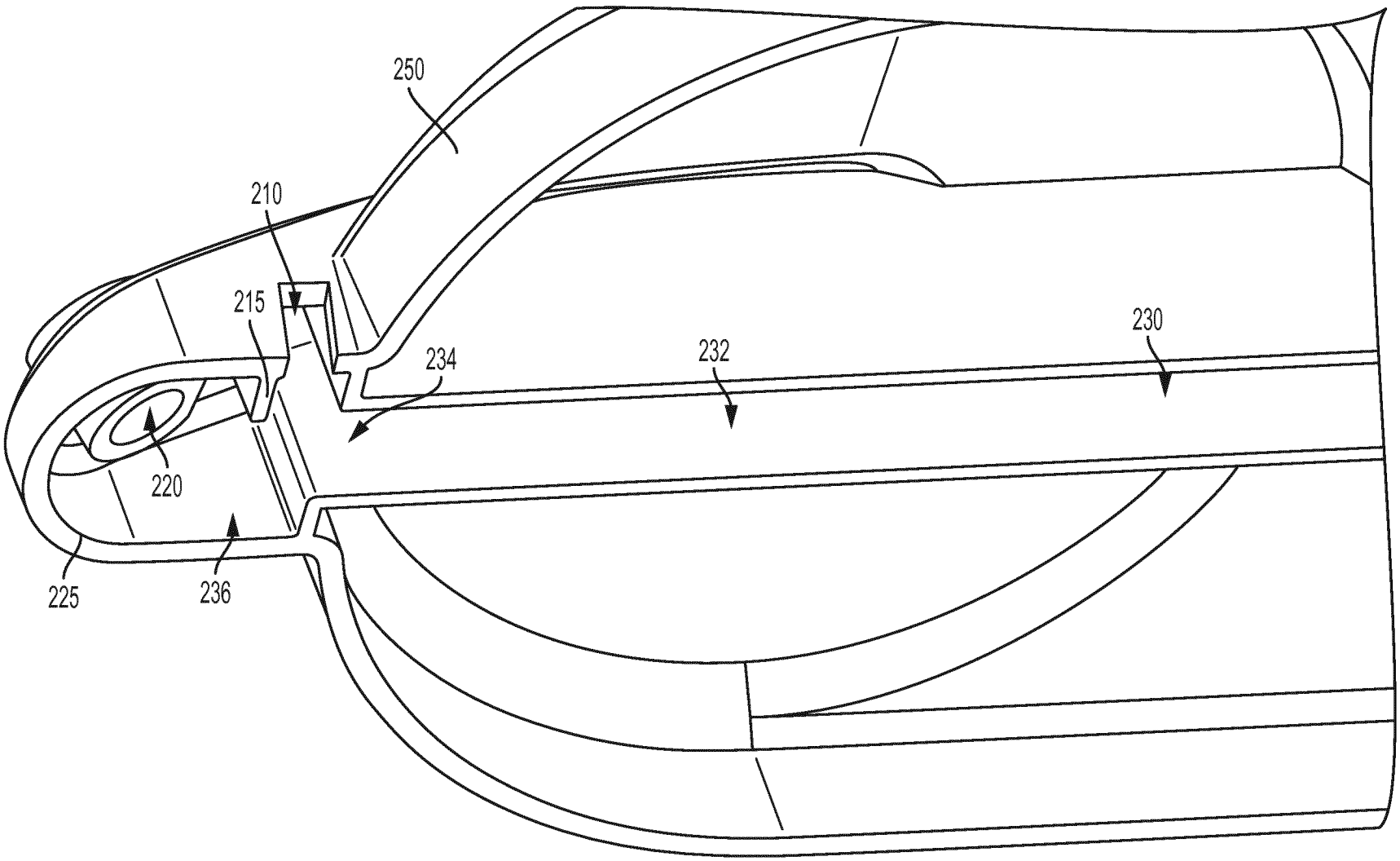
FIG. 8 is a bottom perspective view of a portion of a top part of a spray arm having a spray detergent nozzle, in accordance with an example embodiment.

As shown in FIGS. 3B and 4A, the satellite side 280 further comprises a satellite side fluid supply channel 284. The satellite side fluid supply channel 284 is configured to receive washing liquid (e.g., wash and/or rinse water) from the water conduit 300 and supply and/or provide the washing liquid to the satellite arm 285. In an example embodiment that does not have a satellite arm 285, the satellite side fluid supply channel 284 may be configured to supply and/or provide the washing liquid to a plurality of nozzles disposed on the satellite side 280.

In an example embodiment, as shown in FIGS. 3B and 4A, the driving side 205 comprises a driving side fluid supply channel 230. The driving side fluid supply channel 230 is configured to receive washing liquid from the water conduit 300 and supply and/or provide the washing liquid to the spray detergent nozzle 210 and/or the corner nozzle 220. For example, the spray detergent nozzle 210 and the corner nozzle 220 may, at least in part, share a common fluid supply channel. For example, the driving side fluid supply channel 230 may comprise a narrow fluid supply channel 232 and a fluid supply chamber 236. In an example embodiment, the narrow fluid supply chamber 232 is narrower than the satellite side fluid supply channel 284. In an example embodiment, the narrow fluid supply channel 232 extends from the pivot point 290 to the protrusion 225. In particular, the interior of the protrusion comprises fluid supply chamber 236. The fluid supply chamber 236 receives washing liquid from the narrow fluid supply channel 232 and supplies and/or provides the washing liquid directly to spray detergent nozzle 210 and/or the corner nozzle 220.

Located between the spray detergent nozzle 210 and the corner nozzle 220 in the depicted embodiment is a nozzle differentiation wall 215, in an example embodiment. For example, the wall 215 may extend from a perimeter wall of the fluid supply chamber 236 toward an interior of the fluid supply chamber 236 such that the wall 215 is disposed between the spray detergent nozzle 210 and the corner nozzle 220. In an example embodiment, the nozzle differentiation wall 215 may act to fluidically differentiate so as to differentiate the flow rate between the spray detergent nozzle 210 and the corner nozzle 220. In an example embodiment, the nozzle differentiation wall 215 may further assist in the creation of the fan-shaped jet formed by the spray detergent nozzle 210. In particular, the nozzle differentiation wall 215 may cause washing liquid flowing through the fluid supply chamber 236 and incident upon the nozzle differentiation wall 215 to flow out through the spray detergent nozzle 210 to provide a fan-shaped jet. The differentiation wall may increase the volume of washing liquid to the corner nozzle 220 to help create a better collimated jet, with respect to an embodiment not having a nozzle differentiation wall 215.

FIGS. 5-8 show various views of a portion of a top portion 250 of a spray arm 20. As shown in FIGS. 5-8, the spray detergent nozzle 210 is a slot-shaped opening within a side wall of the protrusion 225 (and/or the driving side 205). In an example embodiment, the spray detergent nozzle 210 may be a rectangular slot-shaped opening. In an example embodiment, the spray detergent nozzle 210 may be a rounded (e.g., elliptical) slot-shaped opening. Generally, the spray detergent nozzle 210 is a slot-shaped opening have a first dimension that defines a first axis and that is larger than a second dimension that defines a second axis, wherein the first and second axes are orthogonal. In an example embodiment, the first dimension defines, at least in part, the angular spread of the fan-shaped jet provided by the spray detergent nozzle 210. In some embodiments, the first axis defining the longer first dimension of the slot may be oriented vertically relative to the in-use position of the dishwasher. In some other embodiments, the first axis defining the longer first dimension of the slot may be substantially vertical, but angled slightly (e.g., with an upper edge radially closer to the mounting point 290 than a lower edge).

In an example embodiment, the spray detergent nozzle 210 is located at an edge of the protrusion 225 oriented to spray the fan-shaped jet at least partially tangential to the direction of rotation of the spray arm. For example, the spray detergent nozzle 210 may be located closer to the interface 234 of the narrow fluid channel 232 and the fluid supply chamber 236 than the cornering nozzle 220 is. In the illustrated embodiment, the spray detergent nozzle 210 is disposed at least in part in the top portion 250. However, in various embodiments, the spray detergent nozzle 210 may be disposed in whole or in part in the bottom portion 255.

Figure 9:
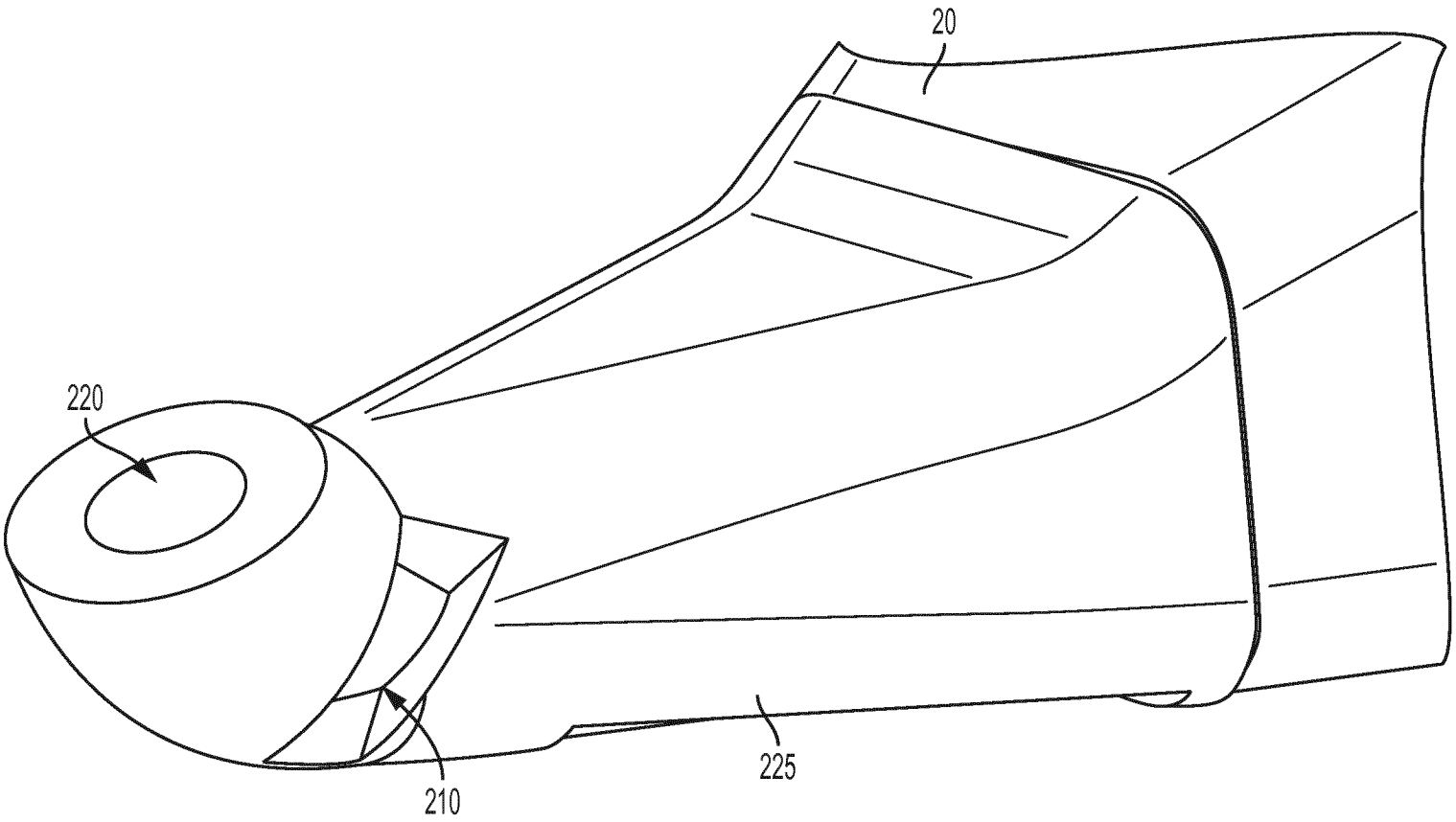
FIG. 9 is a perspective view of a portion of a spray arm having a fan-shaped detergent nozzle, in accordance with an example embodiment.

FIG. 9 illustrates a portion of a driving side 205 of an alternative embodiment. The cross-section of the protrusion 225 perpendicular to the driving side axis may be generally square, rectangular, square with rounded or smoothed corners, rectangular with rounded or smoothed corners, and/or the like. The protrusion 225 is generally tapered along the driving side axis such that the end of the driving side 205 opposite the mounting point 290 is approximately the size of the corner nozzle 220. The corner nozzle 220 may be curved, such that the corner jet emitted by the corner nozzle 220 is emitted at an angle of 0° to 180° with respect to the driving side axis. In an example embodiment, the corner jet is emitted from the corner nozzle at an angle that is between 90° and 180° with respect to the driving side axis. The angle with respect to the driving side axis with which the corner jet is emitted from the corner nozzle 220 may be configured such that the corner jet is incident on the corners of the lower dishrack, middle dishrack and/or upper dishrack, as appropriate for the application. The spray detergent nozzle 210 may be disposed along the protrusion 225 just to the mounting point 290 side of the corner nozzle 220, in the illustrated embodiment. For example, the spray detergent nozzle 210 may be disposed near the end of the protrusion directly before the beginning of the curve that defines the direction at which the corner nozzle 220 emits the corner jet.

Exemplary Fan-Shaped Jet

Figure 10:
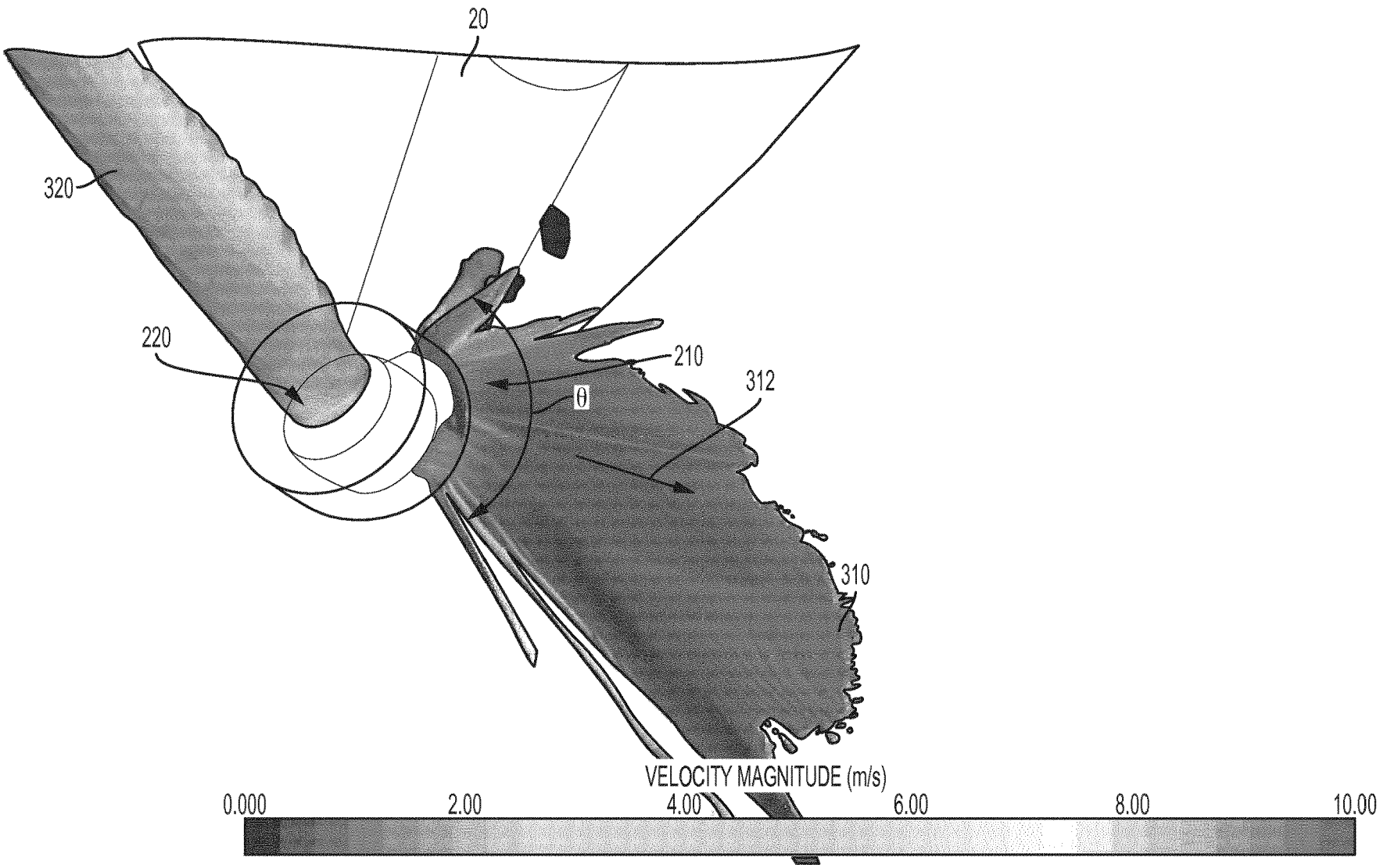
FIG. 10 illustrates results of fluid flow simulation for a portion of a spray arm having a spray detergent nozzle, in accordance with an example embodiment.

FIG. 10 illustrates results of a fluid flow simulation for the corner nozzle 220 and the fan-shaped spray nozzle 210 shown in FIG. 9. As shown in FIG. 10, the jet produced when washing liquid is provided to the spray detergent nozzle 210 is generally fan-shaped. For example, the fan-shaped jet may be a jet that is generally planar or two-dimensional and that expands outward from a first end where the fan-shaped jet leaves the spray detergent nozzle 210 to an end of the fan-shaped jet opposite the spray detergent nozzle. For example, the fan-shaped jet may be shaped as a sector of a circle or an ellipse wherein the center of the circle or the ellipse is located at the nozzle and/or within the spray arm such that the nozzle defines the angle θ of the sector. For example, the fan-shaped jet is defined by an angular extant θ and a resulting force direction 312. In an example embodiment, the resulting force direction 312 is the direction of the average velocity of the washing liquid of the fan-shaped jet provided by the spray detergent nozzle 210. In an example embodiment, the resulting force direction 312 is the direction of the velocity of the fan-shaped jet averaged over the width of the jet along the angular extent θ of the fan-shaped jet 310. For example, in an example embodiment, the resulting force direction 312 is the direction of the velocity direction vector averaged along the angular extent θ from one edge of the fan-shaped jet 310 to the other weighted with the local water flux at each angle. The resulting force direction 312 may be generally opposite the direction of rotation of the spray arm 20, where the direction of rotation is the tangential arc followed by the spray arm as it rotates. For example, emitting the fan-shaped jet via the spray detergent nozzle 210 may impart a force or torque to the spray arm 20, thereby causing the spray arm 20 to rotate in a direction that is generally opposite to the resulting force direction 312 of the fan-shaped jet. For example, the resulting force direction 312 may be generally tangent and opposite to the direction of rotation 320 of the spray arm 20, as shown in FIG. 11. For example, the spray detergent nozzle 210 may be the driving nozzle of the spray arm 20. In some further embodiments, the resulting force direction 312 of the spray detergent nozzle 210 may be generally tangent and opposite to the direction of rotation of the spray arm 20 with respect to the plane of rotation of the spray arm, while being angled at least partially upwardly or downwardly. In some other embodiments, the resulting force direction 312 of the spray detergent nozzle 210 may be at least partially tangent to the direction of rotation of the spray arm. As used herein, a driving nozzle is a nozzle that, when a jet is emitted from the nozzle, causes the spray arm 20 to rotate.

The fan-shaped jet produced when washing liquid is provided to the spray detergent nozzle 210 defines a fan plane. In an example embodiment, the angle θ is defined by the slot shape of the spray detergent nozzle 210. For example, as viewed from a point within the spray arm 20 (e.g., a point within the fluid supply chamber 236), the spray detergent nozzle 210 has an angular width of approximately θ. For example, the length of the slot of the spray detergent nozzle 210 may define the angular extent θ of the fan-shaped jet. For example, the angle θ is in the fan plane. In another example, the resulting force direction 312 is in the fan plane. The fan plane may be a generally vertical plane. For example, the fan-shaped jet defines a fan spread axis. For example, the fan spread axis may be a cord of the arc defined by the angle θ. The fan spread axis may lie in the fan plane and be generally vertical. In an example embodiment, the fan plane is substantially vertical, but is not generally vertical. For example, in an example embodiment, the fan plane may form an angle with a vertical axis that is within the range of 0 and 60°. For example, in one embodiment, the fan plane may form an angle that forms a 10° angle with respect to the vertical axis. As should be understood, FIG. 11 shows an overhead view of spray arm 20 and the line indicated by 310 represents a generally and/or substantially vertical fan-shaped spray.

FIG. 12 schematically shows the spray arm 20 in a first position at first height A in dashed lines and in a second position at second height B in solid lines. For example, in an example embodiment, the upper and/or middle dish rack and/or spray arm 20 may be selectively moveable between a plurality of positions including a first position at first height A and a second position at second height B. For example, the first position may be the highest position of the plurality of positions and the second position may be the lowest position of the plurality of positions. For example, the upper and/or middle dish rack and/or spray arm 20 may be selectively positioned at one of a plurality of heights between the first height A and the second height B. For example, a user may positioned the upper and/or middle dishrack and/or spray arm 20 at a user-selected height of the plurality of heights. The fan-shaped jet 310A emitted from the spray detergent nozzle 210 when the spray arm 20 is in the first position A and the fan-shaped jet 310B emitted from the spray detergent nozzle 210 when the spray arm 20 is in the second position B, are both incident upon the detergent dispenser 45. Moreover, if the spray arm 20 is positioned at any of a plurality of heights with the first height A being the maximum height of the plurality of heights and the second height B being the minimum height of the plurality of heights, the fan-shaped jet 310 will be incident on the detergent dispenser 45. For example, the fan-shaped jet 310A is configured to clean out the detergent dispenser 45. Similarly, the fan-shaped jet 310B is configured to clean out the detergent dispenser 45. For example, the angular extent θ of the fan-shaped jet may be configured such that the width of the fan-shaped jet 310 (e.g., 310A, 310B) when the fan-shaped jet is incident on the door 18 is at least the difference between the first height A and the second height B. In an example embodiment, the fan-shaped jet may not be exactly vertical, but may be substantially vertical. In particular, the fan-shaped jet may be substantially vertical such that the angular extent θ of the fan-shaped jet is configured such that the width of the fan-shaped jet 310 when the fan-shaped jet is incident on the door 18 is at least the difference between the first height A and the height B. For example, the fan-shaped jet 310 is incident upon the detergent dispenser regardless of the height at which the spray arm 20 is positioned between heights A and B. In embodiments having three or more different height positions of the spray arm 20, the fan-shaped jet may be configured such that the width of the fan shaped-jet when the fan-shaped jet is incident on the door 18 is at least as great as the difference between the two most extreme (e.g., highest and lowest) height positions. Thus, the dishwasher 10 need only have one detergent clean out nozzle (e.g., the spray detergent nozzle 210) to ensure the detergent dispenser 45 is sufficiently cleaned out regardless of the position in which the spray arm 20 is mounted and/or positioned.

CONCLUSION

Embodiments of the present invention provide a variety of advantageous over traditional arrangements. As noted above, sufficient cleaning of the detergent dispenser 45 is achieved by a single jet-shaped spray detergent nozzle 210 even when the middle and/or upper dish rack and/or spray arm 20 is selectively moveable between a plurality of positions and/or height. Moreover, the jet-shaped spray detergent nozzle 210 is configured to act as the driving nozzle of the spray arm, thereby reducing the need for a separate driving nozzle.

Embodiments of the present invention provide various advantages. For example, examples of the present invention provide a spray arm 20 having a spray detergent nozzle 210 configured to clean out the detergent dispenser that requires only one spray detergent nozzle even when the spray arm is attached and/or coupled to a height adjustable dish rack 30. For example, the spray arm 20 and spray detergent nozzle 210 reduce the number of non-cleaning nozzles in the spray assembly to effectively utilize the available water pressure (e.g., because only one spray detergent nozzle is needed to clean out the detergent dispenser 45 at various heights and/or positions of the spray arm, because the spray detergent nozzle is also the driving nozzle).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher comprising:

a tub;

a door configured for selectively sealing a forward access opening of the tub;

a detergent dispenser located at an inner surface of the door;

a spray arm mounted within the tub such that the spray arm is adjustable between a plurality of heights comprising a first height and a second height, the first height being the maximum height of the plurality of heights and the second height being the minimum height of the plurality of heights, the spray arm comprising:

a spray detergent nozzle, a corner nozzle positioned adjacent the spray detergent nozzle, a fluid supply channel that supplies fluid to the corner nozzle and to the spray detergent nozzle, and a nozzle differentiation wall that extends into the fluid supply channel from a perimeter wall of the fluid supply channel at a position between the spray detergent nozzle and the corner nozzle to continuously divert a portion of the fluid incident upon the nozzle differentiation wall to the spray detergent nozzle, while continuously permitting a remaining portion of the fluid to proceed through the fluid supply channel to the corner nozzle; and a circulation pump configured to supply washing liquid to the spray arm, wherein the spray arm is configured to emit a fan-shaped jet from the spray detergent nozzle when the washing liquid is supplied to the spray arm, and wherein the fan-shaped jet is incident upon the detergent dispenser when the spray arm is positioned at the first height and when the spray arm is positioned at the second height.

2. The dishwasher of claim 1, wherein the spray detergent nozzle is a drive nozzle of the spray arm configured to cause the spray arm to rotate.

3. The dishwasher of claim 1, wherein the spray arm is rotatable within a plane of rotation, and the spray arm is adjustable along an axis perpendicular to the plane of rotation between the first height and the second height.

4. The dishwasher of claim 1, wherein the spray arm comprises a satellite arm.

5. The dishwasher of claim 4, wherein the spray arm comprises a satellite side fluid supply channel for providing washing liquid to the satellite arm and a driving side fluid supply channel for providing water to the spray detergent nozzle.

6. The dishwasher of claim 5, wherein the driving side fluid supply channel is narrower than the satellite side fluid supply channel.

7. The dishwasher of claim 1, wherein the spray arm is rotatably attached to a fluid supply conduit, and wherein the fluid supply conduit is attached to a height-adjustable dish rack, such that the dish rack is configured to move the spray arm to a user-selected height of the plurality of heights.

8. The dishwasher of claim 1, wherein the spray detergent nozzle and the fan-shaped jet define a fan spread plane in which the fan-shaped jet is disposed, the fan spread plane being generally vertical.

9. The dishwasher of claim 1, wherein the spray detergent nozzle and the fan-shaped jet define a resulting force direction, the resulting force direction being generally tangent and opposite to the direction of rotation of the spray arm.

10. The dishwasher of claim 1, wherein an angular extent of the fan-shaped jet is configured such that a width of the fan-shaped jet, when the fan-shaped jet is incident on the door, is at least a difference between the first height and the second height.

* * * * *